US005505518A

United States Patent [19]

Pike

[11] Patent Number: 5,505,518

[45] Date of Patent: Apr. 9, 1996

[54] INFLATABLE DEVICE FOR ASSISTING IN RAISING A SEATED PERSON TO A STANDING POSITION

[76] Inventor: Oliver E. Pike, 1183 Roxbury Rd., Rockford, Ill. 61107

[21] Appl. No.: 323,842

[22] Filed: Oct. 17, 1994

[51] Int. Cl.[6] ..... A47C 15/00

[52] U.S. Cl. ..... 297/242; 297/DIG. 10; 297/DIG. 8; 5/81.1; 5/654

[58] Field of Search ..... 297/DIG. 10, DIG. 8, 297/180.12, 180.11, 242, 240, 344.21, 344.24; 5/81.1, 654

[56] References Cited

U.S. PATENT DOCUMENTS

| | | | |
|---|---|---|---|
| 3,479,087 | 11/1969 | Burke | 297/339 |
| 4,034,947 | 7/1977 | Geisel | 297/240 |
| 4,905,329 | 3/1990 | Heilner | 297/DIG. 10 |
| 5,318,339 | 6/1994 | Cherniak | 297/242 |
| 5,375,910 | 12/1994 | Murphy | 297/DIG. 10 |
| 5,398,994 | 3/1995 | Thomas | 297/DIG. 10 |

*Primary Examiner*—Peter R. Brown
*Assistant Examiner*—Anthony D. Barfield

[57] ABSTRACT

An inflatable device for assisting in rasing a seated person to a standing position, comprising a base member formed of a rigid material in a planar configuration, the base member having a leading edge and a trailing edge and side edges therebetween. An upper member is formed of a rigid material in a planar configuration, the upper member having a leading edge and a trailing edge and side edges therebetween. A hinge member couples the leading edge of the base member with the leading edge of the upper member to allow the upper member to pivot into an inoperative position essentially parallel with the base member and an operative orientation positioned thereabove being separated to the greatest extent at the trailing edge. An air impervious membrane couples the base member and the upper member around their peripheries in the areas remote from the hinge to thereby define an air chamber between the base member and upper member. A valve is in operative association with the chamber and exterior of the device to allow the relieving of air within the chamber upon a predetermined excess pressure having been attained or upon the selective discretion of the user. Further included are mechanisms to inflate the membrane. A rotating plate is positioned beneath the lower surface of the base member with a axle rotatable bearing therebetween to allow rotation of the base member and components thereabove with respect to the plate to allow a seated person to reorient by rotational movement of the base member with respect to the plate.

1 Claim, 4 Drawing Sheets

FIG 5
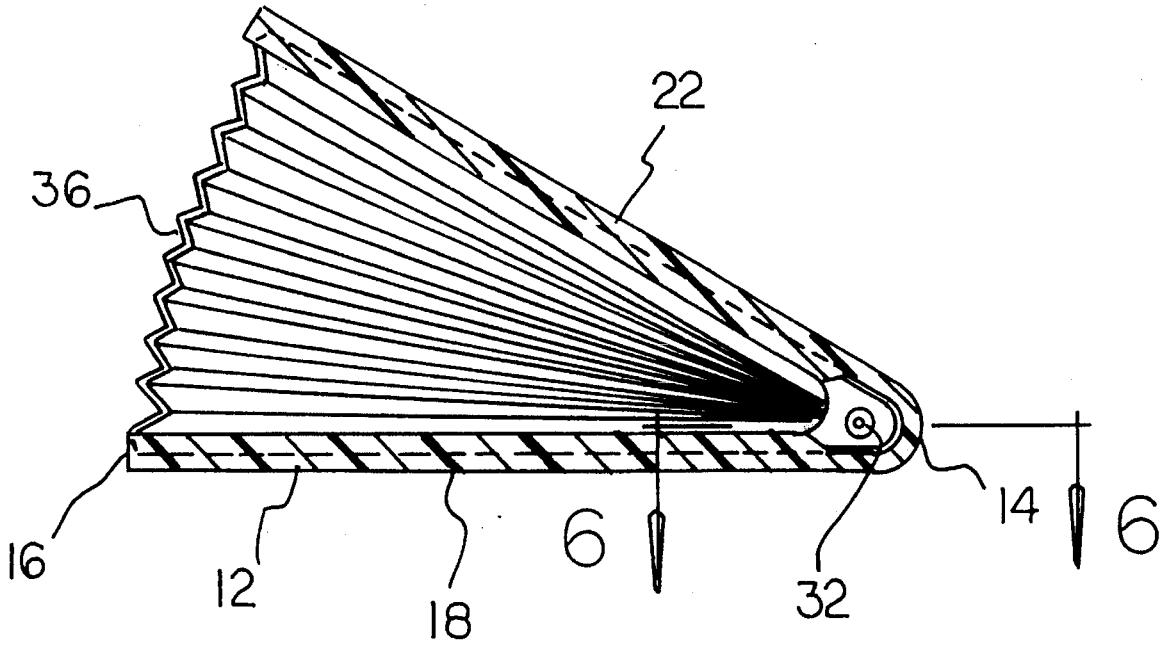
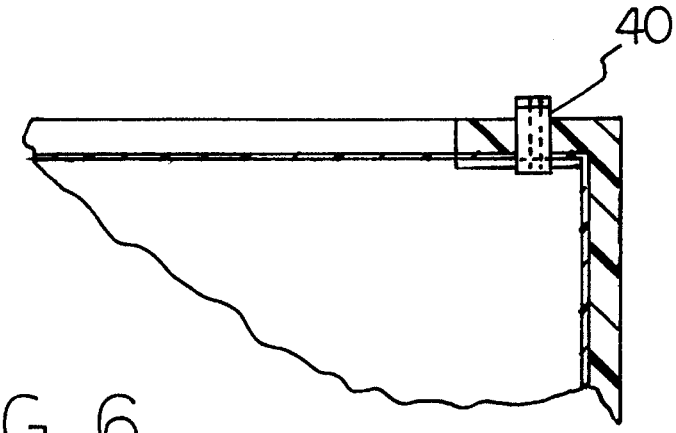
FIG 6

FIG 7
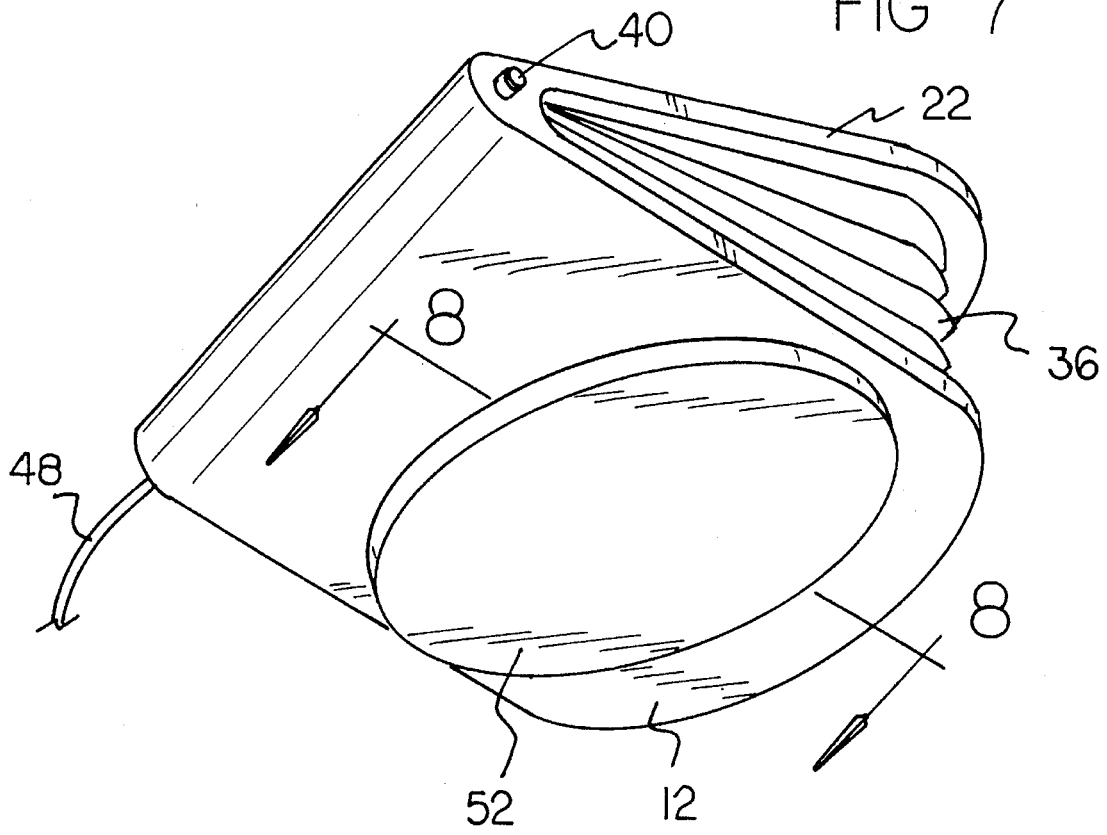
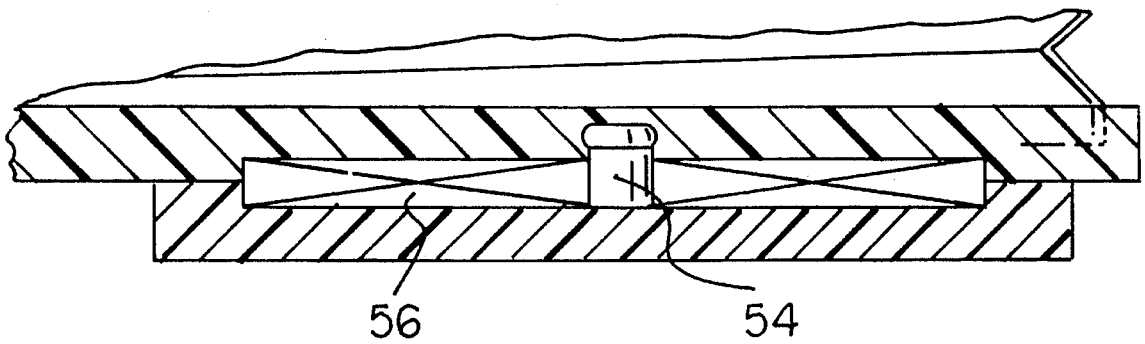
FIG 8

INFLATABLE DEVICE FOR ASSISTING IN RAISING A SEATED PERSON TO A STANDING POSITION

BACKGROUND OF THE INVENTION

1. Field of the Invention

The present invention relates to an inflatable device for assisting in raising a seated person to a standing position and more particularly pertains to assisting people who are seated in elevating themselves through a pneumatic device to raise the person toward a standing position with decreased physical effort.

2. Description of the Prior Art

The use of seats and inflatable devices of a wide variety of designs and configurations is known in the prior art. More specifically, seats and inflatable devices of a wide variety of designs and configurations heretofore devised and utilized for the purpose of providing comfort and assistance to people with decreased physical capabilities by a wide variety of methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art in U.S. Pat. No. 4,190,286 to Bentley discloses an inflatable seat cushion and body support assembly.

U.S. Pat. No. 4,592,589 to Hellwig discloses an inflatable-inflated cushion for seat.

U.S. Pat. No. 4,619,481 to Grudzinskas discloses an inflatable seat cushion assembly.

U.S. Pat. No. 4,789,202 to Alter discloses an inflatable seat cushion.

Lastly, U.S. Pat. No. 5,163,737 to Navach discloses a cushion.

In this respect, the inflatable device for assisting in rasing a seated person to a standing position according to the present invention substantially departs from the conventional concepts and designs of the prior art, and in so doing provides an apparatus primarily developed for the purpose of assisting people who are seated in elevating themselves through a pneumatic device to raise the person toward a standing position with decreased physical effort.

Therefore, it can be appreciated that there exists a continuing need for a new and improved inflatable device for assisting in raising a seated person to a standing position which can be used for assisting people who are seated in elevating themselves through a pneumatic device to raise the person toward a standing position with decreased physical effort. In this regard, the present invention substantially fulfills this need.

SUMMARY OF THE INVENTION

In view of the foregoing disadvantages inherent in the known types of seats and inflatable devices of a wide variety of designs and configurations now present in the prior art, the present invention provides an improved inflatable device for assisting in raising a seated person to a standing position. As such, the general purpose of the present invention, which will be described subsequently in greater detail, is to provide a new and improved inflatable device for assisting in raising a seated person to a standing position apparatus and method which has all the advantages of the prior art and none of the disadvantages.

To attain this, the present invention essentially comprises a new and improved inflatable device for assisting in raising a seated person to a standing position comprising, in combination, a base member formed of a rigid material in a planar configuration, the base member having a linear leading edge and a curved trailing edge and parallel side edges therebetween. An upper member is formed of a rigid material in a planar configuration. The upper member has a linear leading edge and a curved trailing edge and parallel side edges therebetween. The upper member and base member are of an essentially similar peripheral configuration. A U-shaped hinge member is formed of an elastomeric material coupling the leading edge of the base member with the leading edge of the upper member to allow the upper member to pivot into an inoperative position essentially parallel with the base member and an operative orientation positioned thereabove being separated to the greatest extent at the trailing edge. An air impervious membrane couples the base member and the upper member around their peripheries in the areas remote from the hinge to thereby define an air chamber between the base member and upper member. A valve is in operative association with the chamber and exterior of the device to allow the relieving of air within the chamber upon a predetermined excess pressure having been attained or upon the selective discretion of the user. An air compressor has in association therewith an electrical line with a plug adapted to be inserted into the cigarette lighter receptacle of an automobile for the energization thereof. The compressor also has a pneumatic line therefrom to the chamber between the base plate and the upper plate whereby, upon energization of the compressor, air will be fed to the chamber to raise the upper plate with respect to the lower plate to lift a person seated upon the upper surface. A rotating plate is positioned beneath the lower surface of the base member with a axle rotatable bearing therebetween to allow rotation of the base member and components thereabove with respect to the plate to allow a seated person to reorient by rotational movement of the base member with respect to the plate.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved inflatable device for assisting in raising a seated person to a standing position which has all the advantages of the prior art seats and inflatable devices of a wide variety of designs and configurations and none of the disadvantages.

It is another object of the present invention to provide a new and improved inflatable device for assisting in raising a seated person to a standing position which may be easily and efficiently manufactured and marketed.

It is a further object of the present invention to provide a new and improved inflatable device for assisting in raising a seated person to a standing position which is of a durable and reliable construction.

An even further object of the present invention is to provide a new and improved inflatable device for assisting in raising a seated person to a standing position which is susceptible of a low cost of manufacture with regard to both materials and labor, and which accordingly is then susceptible of low prices of sale to the consuming public, thereby making such seats and inflatable devices of a wide variety of designs and configurations economically available to the buying public.

Still yet another object of the present invention is to provide a new and improved inflatable device for assisting in raising a seated person to a standing position which provides in the apparatuses and methods of the prior art some of the advantages thereof, while simultaneously overcoming some of the disadvantages normally associated therewith.

Still another object of the present invention is to assist people who are seated in elevating themselves through a pneumatic device to raise the person toward a standing position with decreased physical effort.

Lastly, it is an object of the present invention to provide a new and improved inflatable device for assisting in raising a seated person to a standing position comprising a base member formed of a rigid material in a planar configuration, the base member having a leading edge and a trailing edge and side edges therebetween. An upper member is formed of a rigid material in a planar configuration, the upper member having a leading edge and a trailing edge and side edges therebetween. A hinge member couples the leading edge of the base member with the leading edge of the upper member to allow the upper member to pivot into an inoperative position essentially parallel with the base member and an operative orientation positioned thereabove being separated to the greatest extent at the trailing edge. An air impervious membrane couples the base member and the upper member around their peripheries in the areas remote from the hinge to thereby define an air chamber between the base member and upper member. A valve is in operative association with the chamber and exterior of the device to allow the relieving of air within the chamber upon a predetermined excess pressure having been attained or upon the selective discretion of the user. Further included are mechanisms to inflate the membrane. A rotating plate is positioned beneath the lower surface of the base member with a axle rotatable bearing therebetween to allow rotation of the base member and components thereabove with respect to the plate to allow a seated person to reorient by rotational movement of the base member with respect to the plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross-sectional view taken along line 5—5 of FIG. 4.

FIG. 6 is a cross-sectional view taken along line 6—6 of FIG. 5.

FIG. 7 is a perspective illustration of an alternate embodiment of the present invention.

FIG. 8 is a cross-sectional view taken along line 8—8 of FIG. 7.

Similar reference characters refer to similar parts throughout the several views of the drawings.

DESCRIPTION OF THE PREFERRED EMBODIMENT

Figure 1:
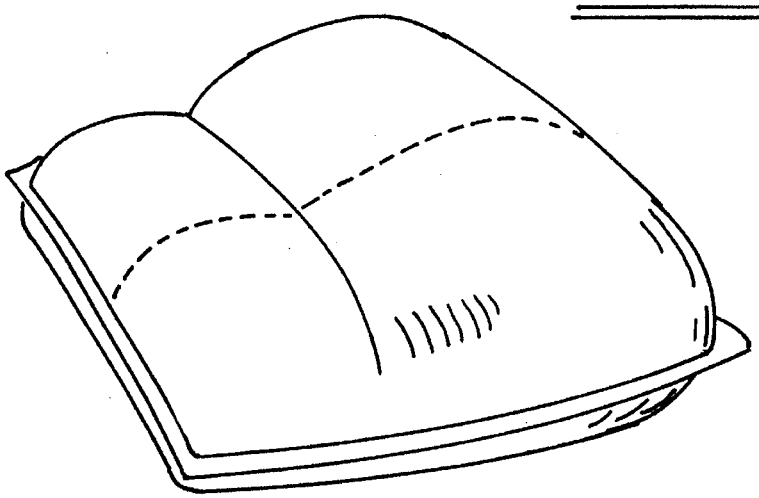
FIG 1 PRIOR ART
FIG. 1 is a pneumatic cushion type device of a prior art design.
Figure 2:
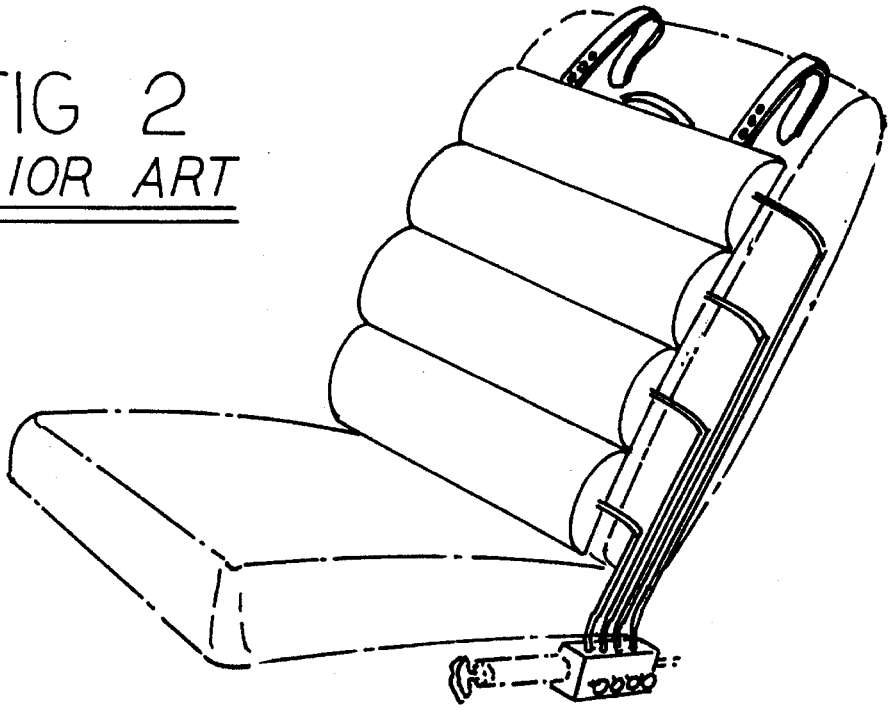
FIG 2 PRIOR ART
FIG. 2 is another prior art device employing pneumatics in association with a chair.
Figure 3:
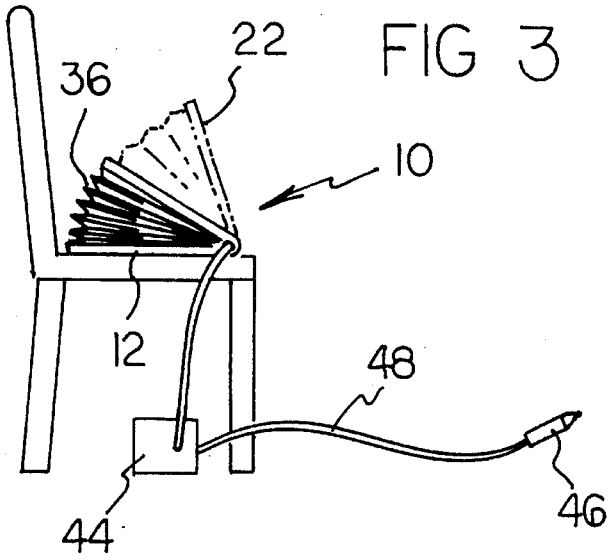
FIG. 3 is side elevational view of the preferred embodiment of the inflatable device for assisting in raising a seated person to a standing position constructed in accordance with the principles of the present invention.
Figure 4:
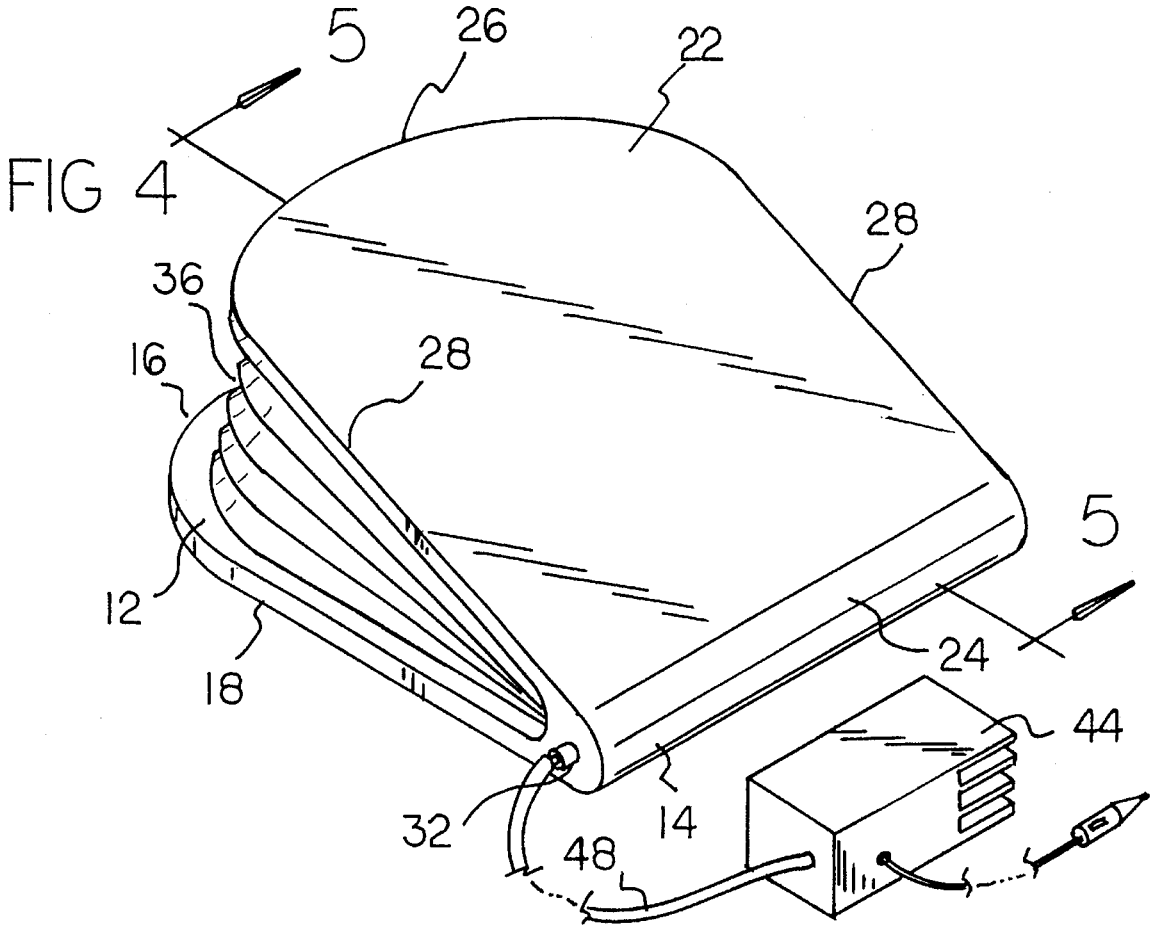
FIG. 4 is an enlarged perspective illustration of the device shown in FIG. 2.

With reference now to the drawings, and in particular to FIG. 3 thereof, a new and improved inflatable device for assisting in raising a seated person to a standing position embodying the principles and concepts of the present invention and generally designated by the reference numeral 10 will be described.

The present invention, the new and improved inflatable device for assisting in raising a seated person to a standing position, is comprised of a plurality of components. Such components in their broadest context include a base member, an upper member, a hinge member, an air impervious membrane, a valve, an air compressor, and a rotating plate. Such components are individually configured and correlated with respect to each other so as to attain the desired objective.

The central component of the system 10 of the present invention is a base member 12. The base member is formed of a rigid material, preferably plastic, in a planar configuration. Such base member has a linear leading edge 14 and a curved trailing edge 16. Parallel side edges 18 are coupled between the leading and trailing edges.

In association with the base member there is provided an upper member 22. Such upper member is formed of a rigid material similar to the base member, preferably plastic. It is configured in a planar configuration. The upper member has a linear leading edge 24 and a curved trailing edge 26. Parallel side edges 28 are coupled between the leading and trailing edges. The upper member and base member are of an essentially similar peripheral configuration.

A U-shaped hinge member 32 formed of an elastomeric material couples the leading edge of the base member with the leading edge of the upper member. This is to allow the upper member to pivot into an inoperative position essentially parallel with the base member. It also allows movement of the upper member into an operative orientation positioned thereabove at a region separated to the greatest extend at the trailing edge.

Next provided is an air impervious membrane 36. Such membrane is coupled to the base member and the upper member around their peripheries. This is in the areas remote from the hinge to thereby define an air chamber. The air chamber is located between the base member and the upper member.

In operative association with the chamber is a valve 40. Such valve is in communication between the chamber and exterior of the device. Its function is to allow the relieving of air from within the chamber upon a predetermined excess pressure having been obtained or, in the alternative, at the selective discretion of the user.

Inflating the membrane is through inflation mechanisms, preferably an air compressor 44. Such air compressor has in association therewith an electrical line terminating in a plug. Such plug is adapted to be inserted into the cigarette lighter receptacle 46 of an automobile, truck or other vehicle. When so inserted it will energize the air compressor. The air compressor also has a pneumatic line 48 extending therefrom to the chamber between the base plate and the upper plate. In this manner, upon energizing of the compressor, air will be fed into the chamber to raise the upper plate with respect to the lower plate. In such manner, there is a lifting of a person seated upon the upper surface.

Lastly provided is a rotating plate 52. The plate is positioned beneath the lower surface of the base member. It is provided with an axle 54 and a rotatable bearing 56 between the base and upper members. This is to allow the rotation of the base members and components thereabove with respect to the plate. In this manner, it would be allowed for a seated person to reorient himself or herself by rotational motion of the base member as well as the upper member with respect to the plate.

The present invention is designed to elevate a handicapped or elderly person from a seated to a standing position. It is simply comprised of the seat itself, an air compressor and an adapter plug. The seat, or cushion, is inflatable and features bellows-like pleats along its rear vertically oriented panel. As it is inflated, the top surface of the cushion will be slightly inclined to support the posterior of the occupant as the legs are straightened.

The air compressor is small and portable and would be approximately equivalent of the mini air compressor manufactured by INTERDYNAMICS. The power connection is a combination transformer/plug which includes an adapter for the cigarette lighter receptacle in a car as well as a standard plug designed to engage a wall socket.

To use the present invention, one need only rotate the cushion in the direction they wish to face when standing and engage the plug. The seat will rise gradually while also tilting forward, and it is then a simple matter to extend the legs and exert a gentle force on the top surface of the cushion to push the body to an erect position. A more sophisticated model of the present invention would feature a swiveling base, and this would be valuable as used in a car where one must rotate ninety degrees to effect an exit.

The muscles and motion used with either model do not include those in the hands and arms since it is these muscles which are typically weak if one is handicapped or partially immobilized. The present invention will promote pride and self reliance and eliminate the need for assistance from a second party. As such, the present invention should indeed be a valuable acquisition for anyone who has difficulty attaining a standing position.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved inflatable device for assisting in raising a seated person to a standing position, comprising, in combination:

a base member formed of a rigid material in a planar configuration, the base member having a linear leading edge and a curved trailing edge and parallel side edges therebetween;

an upper member formed of a rigid material in a planar configuration, the upper member having a linear leading edge and a curved trailing edge and parallel side edges therebetween, the upper member and the base member being of an essentially similar peripheral configuration, the leading edge of the upper member integral with the leading edge of the base member forms a living hinge whereby the upper member can be raised to a position nearly perpendicular to the base member;

an air impervious membrane coupling the base member and the upper member around their peripheries in the areas remote from the leading edges thereof to thereby define an air chamber between the base member and upper member;

a valve in operative association with the chamber and exterior of the device to allow the relieving of air within the chamber upon a predetermined excess pressure having been attained or upon the selective discretion of the user;

an air compressor having in association therewith an electrical line with a plug adapted to be inserted into the cigarette lighter receptacle of an automobile for the energization thereof, the compressor also having a pneumatic line therefrom to the chamber between the base plate and the upper plate whereby, upon energization of the compressor, air will be fed to the chamber to raise the upper plate with respect to the lower plate to lift a person seated upon the upper surface; and a rotating plate positioned beneath the lower surface of the base member with an axle rotatable bearing therebetween to allow rotation of the base member and components thereabove with respect the plate to allow a seated person to reorient by rotational movement of the base member with respect to the plate.

* * * * *